United States Patent [19]

Vaughan

[11] Patent Number: 4,691,555

[45] Date of Patent: Sep. 8, 1987

[54] TUBE BENDING TOOL

[76] Inventor: Donald R. Vaughan, 880 N. East St., Woodland, Calif. 95695

[21] Appl. No.: 854,186

[22] Filed: Apr. 21, 1986

Related U.S. Application Data

[63] Continuation of Ser. No. 671,882, Nov. 15, 1984, abandoned.

[51] Int. Cl.[4] ..... B21J 13/08

[52] U.S. Cl. ..... 72/459; 72/387; 72/159; 72/321

[58] Field of Search ..... 72/458, 459, 388, 387, 72/319, 321, 159, 479; 30/252, 312, 341

[56] References Cited

U.S. PATENT DOCUMENTS

| | | | |
|---|---|---|---|
| 962,926 | 9/1909 | Stephens | 30/312 |
| 1,167,538 | 1/1916 | True . | |
| 1,835,264 | 12/1931 | Blythe | 72/459 |
| 2,171,907 | 9/1939 | Beehler et al. | 72/459 |
| 2,530,215 | 11/1950 | Zidar | 30/341 |
| 2,709,382 | 5/1955 | Safranski | 81/15 |
| 2,908,193 | 10/1959 | Gryniewicz | 72/459 |
| 3,380,283 | 4/1968 | Wilson et al. | 72/459 |
| 3,685,335 | 8/1972 | Kowal | 72/459 |
| 3,818,738 | 6/1974 | Okamuro | 72/321 |
| 4,355,528 | 10/1982 | Rothenberger | 72/454 |
| 4,380,922 | 4/1983 | Kowal | 72/459 |

FOREIGN PATENT DOCUMENTS

| | | | |
|---|---|---|---|
| 131605 | 3/1949 | Australia | 72/459 |
| 454731 | 2/1949 | Canada | 72/459 |
| 688257 | 9/1979 | U.S.S.R. . | |

*Primary Examiner*—Robert L. Spruill
*Assistant Examiner*—David B. Jones
*Attorney, Agent, or Firm*—Julian Caplan

[57] ABSTRACT

A tube bender has two readily connectable and detachable members. A base member has a block with two parallel grooves. The tube groove is formed in an arc having the radius of the desired bend and a cross-section with a radius corresponding to the tube diameter. The second groove has straight sides and an arc similar to the tube groove. Pivotally mounted on the base member adjacent the block is a retainer. In its first position a radius therein clamps the tube in the tube groove. In its second position, a fork fits over the conventional ferrule of a connector fitting. The block is notched opposite the retainer to receive the outer end of the fork and a connector nut. The forming member has a crescent-shaped end of a radius complementary to the second groove so that the crescent may fit snugly in the second groove. A forming block on the forming member engages the outside of the tube and causes it to conform to the shape of the groove. For manual operation, the two members have diverging handles.

11 Claims, 10 Drawing Figures

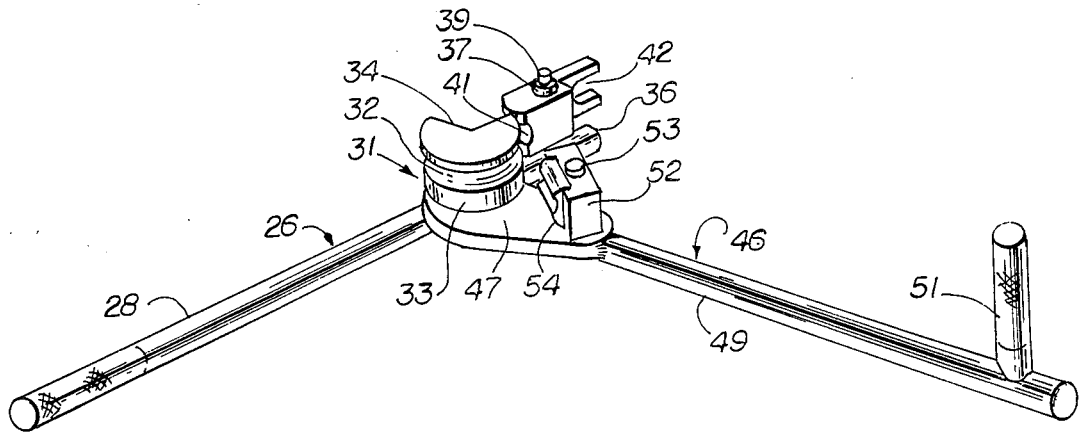

TUBE BENDING TOOL

This is a continuation of co-pending application Ser. No. 06/671,882 filed on Nov. 15, 1984, now abandoned.

FIELD OF THE INVENTION

This invention relates to a new and improved tool for bending tubing. Although the invention herein illustrated and described is hand held, it will be understood that by eliminating the handles, or by mounting one of the handles in a vise, the invention may be bench-mounted.

DESCRIPTION OF THE PRIOR ART

Prior hand-held benders are limited in the kinds of bends which may be performed as compared with the versatility of the bends performed by the present invention. Stationary benders, although they can perform all required bends, are not portable and, hence, make it awkward, or impossible, to use them for repair in maintenance work. Accordingly, the present invention improves the flexibility of prior tools, reduces the costs and increases efficiency.

U.S. Pat. No. 2,908,193 shows a manual bender. However, where a 180° bend is performed, it is not possible to remove the tubing from the tool without removing a main bolt and disassembling. The present invention employs a two-piece tool which is easily disassembled so that the bent tube can be removed or repositioned for further bending.

U.S. Pat. No. 4,380,922 also cannot make a 180° bend. The bolt thereof must be removed to disengage the hook. Further, it is impossible with this tool to position the ferrule and nut of a connector fitting close to the center line.

U.S. Pat. No. 3,380,283 employs a swing latch to position the two parts of the tool together. In the present invention, the parts are more readily assembled. As a matter of fact, two latches are required in U.S. Pat. No. 3,380,283 and work bent 180° cannot be removed without deformation.

U.S. Pat. No. 1,167,538 is a bench-mounted device having some similarity to applicant's construction in that it has provision for bending tubing close to a fitting on one end of the tube, but lacks other details hereinafter described.

Other prior art known to applicant includes Canadian Pat. No. 454,731, Australian Pat. No. 131,605 and U.S. Pat. No. 3,685,335.

OBJECTS OF THE INVENTION

A principal object of the present invention is to provide a tool which will commence a bend of a tube close to the end thereof, whether there is a fitting on the end or not. Thus, the tool has a retainer for the end of the tube adjustable between two positions. In one position, the retainer directly engages the tube. In the other position, the retainer engages a ferrule which conventionally is attached to the end of the tube provided with a fitting or other connecting means.

Another feature of the invention is the provision of a notch in the radius block which controls the bend, this notch accommodating the nut and ferrule of tubes having such means on one of their ends and also permits close forming of the tubing into 180° bends with one turn of the handle.

Another feature of the invention is the fact that the forming member is readily connectable to and detachable from the radius block. The forming member has a crescent-shaped portion which fits into a complementary groove in the radius block. The crescent widens toward its handle to increase its strength. A still further feature of the invention is the fact that the portion of the forming member which actually contacts the tube comprises a forming block pivotted to its handle, which is self-adjusting for alignment with the tube, thereby applying proper pressure to the tube during the bending operation. The pivotal mounting of this forming block relative to its handle also afford wear compensation.

Still another feature of the invention is the fact that there is a plastic insert in the heretofore described forming block which prevents scoring the tube during the bending operation.

Still another feature of the invention is the fact that it is provided with a grip at right angles to the length of at least one handle which prevents the fingers being caught between the forming member handle and the block handle in the manual version of the bender hereinafter described in detail.

SUMMARY OF THE INVENTION

The tool of the present invention consists of two pieces which are detachable. In the preferred embodiment illustrated, the two pieces are provided with handles for manual fabrication of bends in tubing, although a handle may be eliminated in one of the members and it may be mounted on a bench or vise. The forming member has a crescent-shaped extension which fits into a groove in a radius block and thus functions as a connector and a guide for pivotal movement of the forming member relative to the radius block.

The base member has a radius block with one arcuate groove to receive the crescent-shaped extension of the forming member and a second arcuate groove of a cross-sectional shape to accommodate the diameter of tubing being fabricated and having a radius which determines the radius of the bend. A retainer is pivotally mounted adjacent the radius block so that it may assume either of two working positions. In one position, the end of the retainer is formed with a radius complementary to the radius of the tubing being fabricated and positioned opposite the groove in the radius block. This position of the retainer will accommodate most bending operations. The second working position of the retainer is fork-shaped and the distance between the forks accommodates the ferrule which is conventionally fixed to one end of a tube provided with a nut or other connector fitting. This end of the retainer extends outward from the pivot point a greater distance than the first working position end of the retainer.

The radius block is cut away in a notch to accommodate the retainer and the nut which projects beyond the same. The notch is preferably of an angle of 135° to permit not only the fabrication step heretofore mentioned, but also to facilitate removal of the bent tube from the radius block after a 180° bend has been formed.

The forming member may be provided with a pivotted block having an insert of a hard plastic which engages the outside of the tube during the bending operation. Pivotal mounting of this block insures proper pressure against the tube and accommodates adjustment for wear. The block has a plastic insert which contacts the tube and is less likely to score the same than if a metal block contacted the tube.

Other objects of the present invention will become apparent upon reading the following specification and referring to the accompanying drawings in which similar characters of reference represent corresponding parts in each of the several views.

IN THE DRAWINGS

DETAILED DESCRIPTION OF PREFERRED EMBODIMENT

The present invention is intended for bending tubing 21, preferably of a specific diameter. A bend having a predetermined radius is performed. The tube may be bent along any point of its length. A feature of the invention is the fact that it may be bent closely adjacent one end which is provided with a connector fitting 22, or other fitting, such fittings conventionally have a ferrule 23 secured to the end and functioning with the fitting 22.

Figure 2:
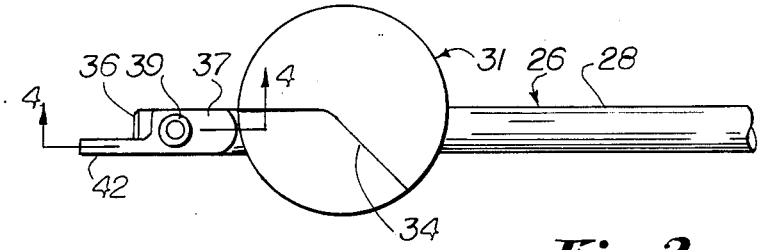
FIG. 2 is a top plan view of the base member.
Figure 3:
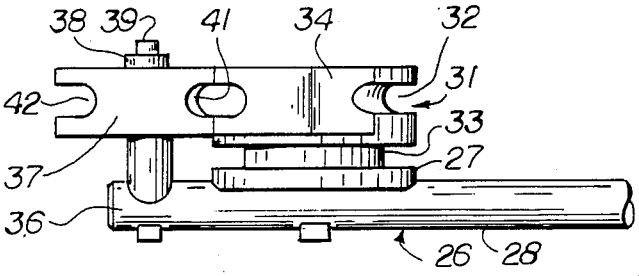
FIG. 3 is a side elevational view of the structure of FIG. 2.

The tool of the present invention has two main parts. Base member 26, has a support 27 fixed thereto from which in the manual form of the tool herein illustrated, there extends an elongated handle 28. Block 31 is fixed to support 27 and is formed with a tube groove 32 having a radius of curvature equal to the radius of tubing 21 adjacent its top and a crescent receiving groove 23 therebelow. Directing attention particularly to FIG. 2 it will be seen that there is a notch 34 of approximately 135° arcuate length formed in block 31.

Figure 8:
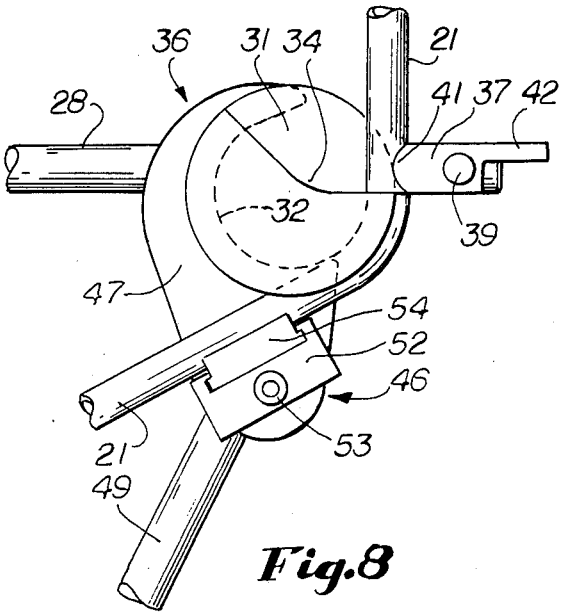
FIG. 8 is a view similar to FIG. 7 showing the tube used to bend tubing intermediate its length.
Figure 7:
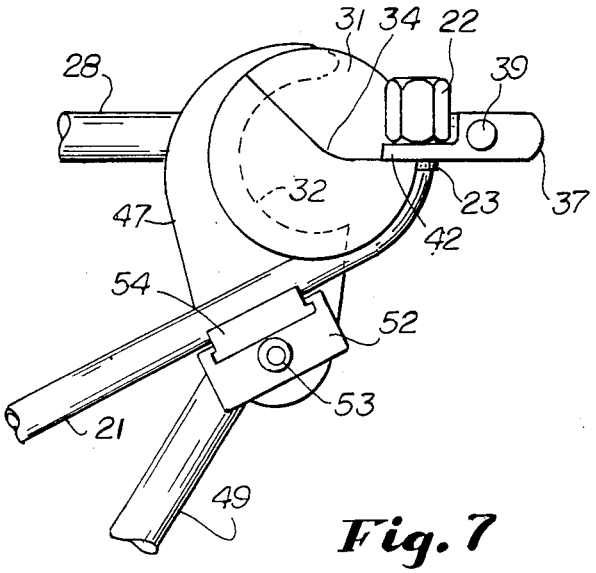
FIG. 7 is a view showing partial completion of a bend of a tube of the type having a connector fitting at one end.
Figure 9:
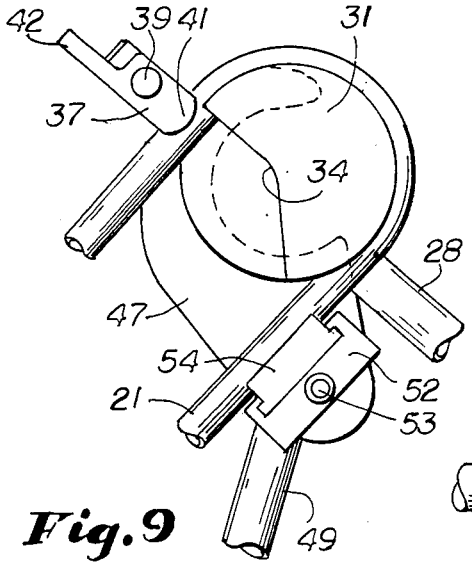
FIG. 9 is a view similar to FIG. 8 showing completion of a bend of 180°.
Figure 10:
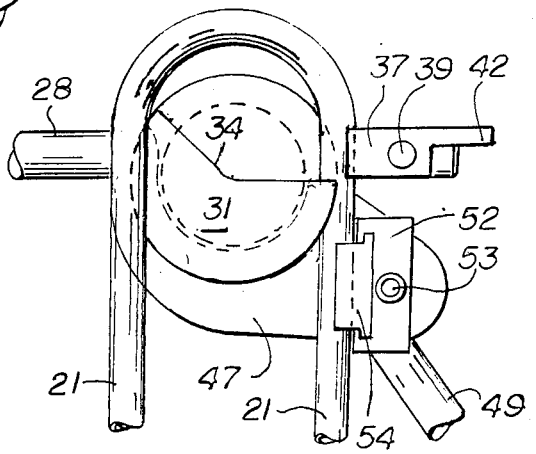
FIG. 10 is a view similar to FIGS. 8 and 9 showing partial completion of the formation of a tube into a helix.

Handle 28 has an extension 36 with an upstanding foot 40 beyond support 27 to support retainer block 37 connected thereto by trunnion 38 and bolt 39. Retainer block 37 has a first end formed with a groove 41 having a radius the same as the radius of groove 32 and positioned directly opposite the same so as to hold tubing 21 against the radius block 34 and prevent its longitudinal or lateral movement. Use of this first end of the retainer is best shown in FIGS. 8–10. Retainer 37 has a second end 42 formed with a fork. Use of the retainer 37 in this position is best shown in FIG. 7, wherein it will be seen that the fork 42 fits over the ferrule 23, holding the nut 22 in position. The fork end 42 fits within the notch 34. Notch 34 also accommodates the nut 22. Thus, the tube may be bent very close to the ferrule 23, an operation which is not accommodated in other hand-held benders.

Figure 5:
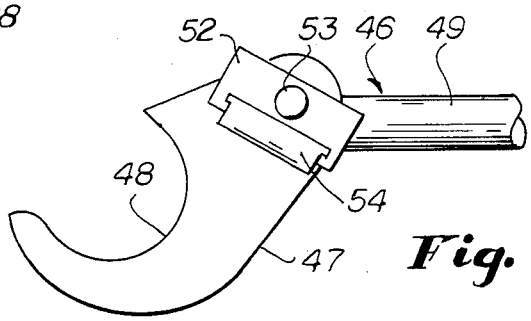
FIG. 5 is a top plan view of the forming member.
Figure 4:
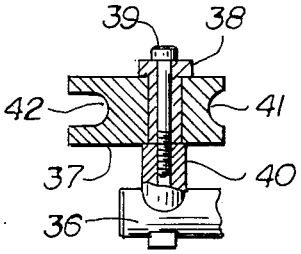
FIG. 4 is a fragmentary sectional view taken substantially along the line 4—4 of FIG. 3.
Figure 6:
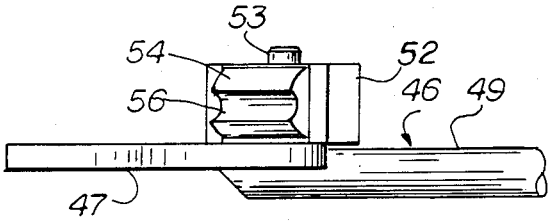
FIG. 6 is side elevational view thereof.

Forming member 46 has a crescent-shaped end 47, best shown in FIG. 5, the crescent end 47 being formed with a radius 48 which is complementary to the diameter of the bottom of the groove 33. Groove 33 has a width slightly greater than the thickness of the crescent 47. Thus, the crescent 47 fits into groove 33 and radius 48 engages the base of groove 33.

Figure 1:
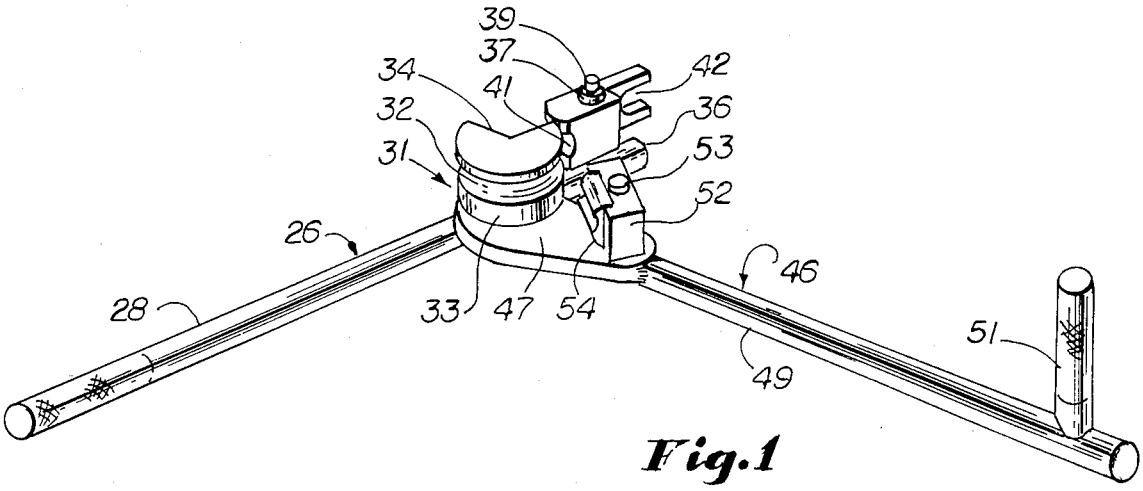
FIG. 1 is a perspective view showing the tool of the present invention assembled.

Extending away from crescent 47 is a handle 49 which may be provided with a grip 51 at right angles thereto. Positioning the grip, as best shown in FIG. 1, prevents the fingers from being squeezed between the handles 28 and 49 when the tool is being used.

Mounted on the crescent 47 is a forming block 52 attached thereto by a pivot 53. Inserted in forming block 52 is an insert 54 which may be of a plastic material such as Delrin. The insert 54 is formed with a groove 56 of the radius of the tubing 21.

Directing attention now to the usage of the invention shown in FIG. 7, the retainer 37 is positioned with the forked end 42 extending into the notch 34 in radius block 31. The ferrule 23 extends through the fork 42 and the nut 22 contacts the fork 42. The position shown in FIG. 7 permits a bend to be formed closely adjacent to the ferrule 23. The crescent 47 is then inserted in the groove 33, so that the insert 54 contacts the outside of the tubing 21 closely adjacent the ferrule 23. The pivot 53 permits the block 52 and particularly the insert 54 to contact tubing 21 close to the ferrule 23 and adjusts readily. The handles 28 and 29 are then drawn together causing the base member 26 and forming members 46 to rotate relative to each other. The 135° extent of the notch 34 permits a 180° bend of the tubing 21 and yet permits the crescent 47 to be withdrawn from the groove 33 without the necessity of deforming the bent tube. Additional bending of the tube more than 180° into a helix or into various other shapes may readily be performed.

Turning attention now to FIG. 8, the retainer 37 is rotated 180° about pivot 38 so that the groove 41 contacts the exterior of tubing 21. The crescent 47 is then inserted in the groove 33 so that the insert 54 engages the outside of tubing 21 closely adjacent the fitting 37. Handles 28 and 49 are drawn together (as partially shown in FIG. 8) causing the tubing 21 to be bent to the degree shown in FIG. 8. Continued movement of the handles 28 and 49 toward each other completes a 180° bend. Thereupon, the crescent 47 is withdrawn from its groove 33 and the bent tubing 21 may be removed from the groove 32 and the radius block 31. The fact that the notch 34 has a 135° extent permits removal of the tubing without deformation. The bent tubing may then be reinstalled between the retainer 37 and the radius block. The curved portion of the tubing is positioned above the level of the block 31. The distance between the groove 32 and the top of the block 31 determines the minimum pitch of a helix formed in tubing 21. The operation may be continued in 180° (or less) increments by repeatedly removing the crescent 47, repositioning the tubing in the retainer 37 and repeating the previously described operation.

Although the device has been described as having handles 28 and 49, it will be understood nevertheless, that the handle 28 may be omitted and the support 27 mounted on a bench or the handle 28 may be gripped in a vise. Instead of by the handle 49, the forming member 46 may be turned by power.

What is claimed is:

1. A tube bender for use with a tube having a given external radius comprising a block having a peripheral edge face which is cylindrical about a first axis of rotation, said block being formed with an arcuate first semi-circular cross-section tube-receiving groove recessed into said edge face, said first axis being the center of said arcuate groove, a retainer, support means mounting said retainer a fixed distance from said block, said retainer having an end formed with a straight second semi-circular cross-section tube-receiving groove, said first and second grooves generally facing toward each other, a forming mcmber having a shoe formed with a third semi-circular cross-section tube-receiving groove, means detachably mounting said forming member on said block for rotative movement about said first axis, said first, second and third grooves lying in a common plane perpendicular to said first axis and also all having the same radius of curvature approximately equal to the external radius of the tube to be formed, said retainer and said shoe each being positionable with said second and third grooves aligned along a common second axis lying in said common plane, the centers of curvature for said second and third grooves lying on said second axis, said retainer and said shoe lying on opposite sides of a second plane passing through said first axis perpendicular to said second axis, said second plane intersecting said second groove.

2. A tube bender according to claim 1 in which said block is formed with a retangular cross-section circumferential fourth groove having a bottom in said peripheral edge face having its center on said first axis, said forming member having a flat crescent-shaped extension having a thickness substantially equal to the width of said fourth groove to detachably fit snugly into said fourth groove and having a curved edge substantially complementary to the bottom of said fourth groove.

3. A tube bender according to claim 1 for use with a tube having a ferrule and nut on said ferrule in which said block is formed with a notch opposite said retainer whereby said nut fits partially within said notch, said notch removing a substantial portion of said block at the level of said first groove, said notch having an arcuate length of about 135° extending from said retainer in a direction about said first axis opposite said forming member, whereby a tube bent about 180° may be removed from said block without distortion of said tube.

4. A tube bender according to claim 3 in which said retainer has a first end formed with said second groove and a second end formed with a fork shaped to receive a conventional tube fitting ferrule positioned when proximate said block to clamp said ferrule against said first groove, said support means comprising a pivot having a pivot axis parallel to said first axis whereby either said first end or said second end may be positioned proximate said block, said second end when proximate said block extending partially into said notch.

5. A tube bender according to claim 1 which further comprises a first handle extending from said block substantially radially relative to said first axis, a second handle extending from said forming member substantially radially relative to said first axis in the assembled condition of said tube bender, said handles being parallel and moving in parallel, spaced apart planes.

6. A tube bender according to claim 5 in which one of said handles has a grip at right angles to said one handle.

7. A tube bender according to claim 1 in which said block is formed with a fourth arcuate groove concentric with and parallel to said first groove, said forming member having a crescent-shaped extension shaped to fit partially is said fourth groove, said extension being formed with an arcuate surface complementary to said fourth groove.

8. A tube bender comprising a block having an arcuate surface formed with an arcuate first tube receiving groove and a second groove concentric with and parallel to said first groove, a forming member, said forming member having an extension formed with an arcuate surface complementary to said second groove, said extension being of a thickness to detachably fit snugly into said second groove, whereby when said extension is located in said second groove said block and said forming member may move rotatively relative to each other, a forming block on said forming member formed with a third groove, said first and third grooves being spaced to receive a tube therebetween, whereby, upon relative rotative movement of said block and said forming member, said forming member bends said tube to conform to said arcuate first groove, and retaining means to retain said tube relative to said block.

9. A tube bender according to claim 8 in which said block is formed with a notch removing a substantial portion of said block at the level of said first groove, said notch having an arcuate length of about 135° extending from said retainer in a direction about said first axis opposite said forming member, whereby a tube bent about 180° may be removed from said block without distortion of said tube.

10. A tube bender according to claim 8 which further comprises a first handle extending substantially radially from said block relative to the center of the arc of said first groove and a second handle extending from said forming members, said handles lying in parallel spaced apart planes.

11. A tube bender according to claim 10 in which one said handle has a grip perpendicular to said one handle.

* * * * *